United States Patent [19]

Jacks et al.

[11] Patent Number: 4,692,941

[45] Date of Patent: Sep. 8, 1987

[54] REAL-TIME TEXT-TO-SPEECH CONVERSION SYSTEM

[75] Inventors: Richard P. Jacks, Manhattan Beach; Richard P. Sprague, Tustin, both of Calif.

[73] Assignee: First Byte, Long Beach, Calif.

[21] Appl. No.: 598,892

[22] Filed: Apr. 10, 1984

[51] Int. Cl.[4] ..... G10L 5/00

[52] U.S. Cl. ..... 381/52

[58] Field of Search ..... 381/51–53; 364/513.5

[56] References Cited

U.S. PATENT DOCUMENTS

| | | | |
|---|---|---|---|
| 3,158,685 | 11/1964 | Gerstman et al. | 381/52 |
| 3,175,038 | 3/1965 | Mauch | 381/52 |
| 3,632,887 | 1/1972 | Leipp et al. | 381/52 |
| 3,704,345 | 11/1972 | Coker | 381/52 |

*Primary Examiner*—E. S. Matt Kemeny

*Attorney, Agent, or Firm*—Weissenberger & Peterson

[57] ABSTRACT

A high-quality, real-time text-to-speech synthesizer system handles an unlimited vocabulary with a minimum of hardware by using a microcomputer-software-compatible time domain methodology which requires a minimum of memory and computational power. The system first compares test words to an exception dictionary. If the word is not found therein, the system applies standard pronunciation rules to the text word. In either instance, the text word is converted to a phoneme sequence. By the use of look-up tables addressed by pointers contained in a phoneme-and-transition matrix, the synthesizer translates the sequence of phonemes and transitions therebetween into sequences of small speech segments capable of being expressed in terms of repetitions of variable-length portions of short digitally stored waveforms. In general, unvoiced transitions are produced by a sequence of segments which can be concatenated in forward or reverse order to generate different transitions out of the same segments; while voiced transitions are produced by interpolating adjacent phonemes for additional memory savings. Pitch can be varied for naturalness of sound, and/or for intonation chanbes derived from key words and/or punctuation in the text, by truncating or extending the waveforms of individual voice periods corresponding to voiced segments.

17 Claims, 17 Drawing Figures

REAL-TIME TEXT-TO-SPEECH CONVERSION SYSTEM

This invention relates to text-to-speech synthesizers, and more particularly to a software-based synthesizing system capable of producing high-quality speech from text in real time using most any popular 8-bit or 16-bit microcomputer with a minimum of added hardware.

BACKGROUND OF THE INVENTION

Text-to-speech conversion has been the object of considerable study for many years. A number of devices of this type have been created and have enjoyed commercial success in limited applications. Basically, the limiting factors in the usefulness of prior art devices were the cost of the hardware, the extent of the vocabulary, the quality of the speech, and the ability of the device to operate in real time. With the advent and widespread use of microcomputers in both the personal and business markets, a need has arisen for a system of text-to-speech conversion which can produce highly natural-sounding speech from any text material, and which can do so in real time and at very small cost.

In recent times, the efforts of synthesizer designers have been directed mostly to improving frequency domain synthesizing methods, i.e. methods which are based upon analyzing the frequency spectrum of speech sound and deriving parameters for driving resonance filters. Although this approach is capable of producing good quality speech, particularly in limited-vocabulary applications, it has the drawback of requiring a substantial amount of hardware of a type not ordinarily included in the current generation of microcomputers.

An earlier approach was a time domain technique in which specific sounds or segments of sounds (stored in digital or analog form) were produced one after the other to form audible words. Prior art time domain techniques, however, had serious disadvantages: (1) they had too large a memory requirement; (2) they produced unnaturally rapid and discontinuous transitions from one phoneme to another; and (3) their pitch levels were inflexible. Consequently, prior art time domain techniques were impractical for high-quality, low-cost real-time applications.

SUMMARY OF THE INVENTION

The present invention provides a novel approach to time domain techniques which, in conjunction with a relatively simple microprocessor, permits the construction of speech sounds in real time out of a limited number of very small digitally encoded waveforms. The technique employed lends itself to implementation entirely by software, and permits a highly natural-sounding variation in pitch of the synthesized voice so as to eliminate the robot-like sound of early time domain devices. In addition, the system of this invention provides smooth transitions from one phoneme to another with a minimum of data transfer so as to give the synthesized speech a smoothly flowing quality. The software implementation of the technique of this invention requires no memory capacity or very large scale integrated circuitry other than that commonly found in the current generation of microcomputers.

The present invention operates by first identifying clauses within text sentences by locating punctuation and conjunctions, and then analyzing the structure of each clause by locating key words such as pronouns, prepositions and articles which provide clues to the intonation of the words within the clause. The sentence structure thus detected is converted, in accordance with standard rules of grammar, into prosody information, i.e. inflection, speech and pause data.

Next, the sentence is parsed to separate words, numbers and punctuation for appropriate treatment. Words are processed into root form whenever possible and are then compared, one by one to a word list or lookup table which contains those words which do not follow normal pronunciation rules. For those words, the table or dictionary contains a code representative of the sequence of phonemes constituting the corresponding spoken word.

If the word to be synthesized does not appear in the dictionary, it is then examined on a letter-by-letter basis to determine, from a table of pronunciation rules, the phoneme sequence constituting the pronunciation of the word.

When the proper phoneme sequence has been determined by either of the above methods, the synthesizer of this invention consults another lookup table to create a list of speech segments which, when concatenated, will produce the proper phonemes and transitions between phonemes. The segment list is then used to access a data base of digitally encoded waveforms from which appropriate speech segments can be constructed. The speech segments thus constructed can be concatenated in any required order to produce an audible speech signal when processed through a digital-to-analog converter and fed to a loudspeaker.

In accordance with the invention, the individual waveforms constituting the speech segments are very small. For example, in voiced phonemes, sound is produced by a series of snapping movements of the vocal cords, or voice clicks, which produce rapidly decaying resonances in the various body cavities. Each interval between two voice clicks is a voice period, and many identical periods (except for minor pitch variations) occur during the pronunciation of a single voiced phoneme. In the synthesizer of this invention, the stored waveform for that phoneme would be a single voice period.

According to another aspect of the invention, the pitch of any voiced phoneme can be varied at will by lengthening or shortening each voice period. This is accomplished in a digital manner by increasing or decreasing the number of equidistant samples taken of each waveform. The relevant waveform of a voice period at an average pitch is stored in the waveform data base. To increase the pitch, samples at the end of the voice period waveform (where the sound power is lowest) are truncated so that each voice period will contain fewer samples and therefore be shorter. To decrease the pitch, zero value samples are added to the stored waveform so as to increase the number of samples in each voice period and thereby make it longer. In this manner, the repetition rate of the voice period (i.e. the pitch of the voice) can be varied at will, without affecting the significant parts of the waveform.

Because of the extreme shortness of the speech segments used in the segment library of this invention, spurious voice clicks would be produced if substantial discontinuities in at least the fundamental waveform were introduced by the concatenation of speech segments. To minimize these discontinuities, the invention provides for each speech segment in the segment library to be phased in such a way that the fundamental frequency waveform begins and ends with a rising zero crossing. It will be appreciated that the truncation or extension of voice period segments for pitch changes may produce increased discontinuites at the end of voiced segments; however, these discontinuities occur at the voiced segment's point of minimum power, so that the distortion introduced by the truncation or extension of a voice period remains below a tolerable power level.

The phasing of the speech segments described above makes it possible for transitions between phonemes to be produced in either a forward or a reverse direction by concatenating the speech segments making up the transition in either forward or reverse order. As a result, inversion of the speech segments themselves is avoided, thereby greatly reducing the complexity of the system and increasing speech quality by avoiding sudden phase reversals in the fundamental frequency which the ear detects as an extraneous clicking noise.

Because transitions require a large amount of memory, substantial memory savings can be accomplished by the interpolation of transitions from one voiced phoneme to another whenever possible. This procedure requires the memory storage of only two segments representing the two voiced phonemes to be connected. The transition between the two phonemes is accomplished by producing a series of speech segments composed of decreasing percentages of the first phoneme and correspondingly increasing percentages of the second phoneme.

Typically, most phonemes and many transitions are composed of a sequence of different speech segments. In the system of this invention, the proper segment sequence is obtained by storing in memory, for any given phoneme or transition, an offset address pointing to the first of a series of digital words or blocks. Each block includes waveform information relating to one particular segment, and a fixed pointer pointing to the block representing the next segment to be used. An extra bit in the offset address is used to indicate whether the sequence of segments is to be concatenated in forward or reverse order (in the case of transitions). Each segment block contains an offset address pointing to the beginning of a particular waveform in a waveform table; length data indicating the number of equidistant samples to be taken from that particular wave form (i.e. the portion of the waveform to be used); voicing information; repeat count information indicating the number of repetitions of the selected waveform portion to be used; and a pointer indicating the next segment block to be selected from the segment table.

It is the object of the invention to use the foregoing techniques to produce high quality real-time text-to-speech conversion of an unlimited vocabulary of polysyllabic words with a minimum amount of hardware of the type normally found in the current generation of microcomputers.

It is a further object of the invention to accomplish the foregoing objectives with time domain methodology.

DESCRIPTION OF THE PREFERRED EMBODIMENT

Figure 1:
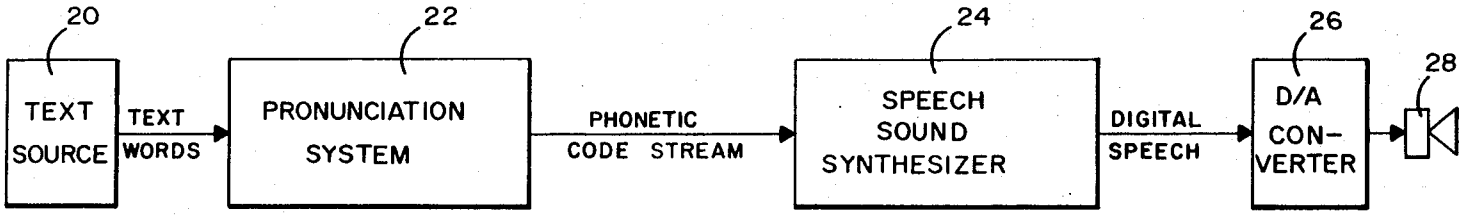
FIG. 1 is a block diagram illustrating the major components of the apparatus of this invention.

The overall organization of the text-to-speech converter of this invention is shown in FIG. 1. A text source 20 such as a programmable phrase memory, an optical reader, a keyboard, the printer output of a computer, or the like provides a text to be converted to speech. The text is in the usual form composed of sentences including text words and/or numbers, and punctuation. This information is supplied to a pronunciation system 22 which analyzes the text and produces a series of phoneme codes and prosody indicia in accordance with methods hereinafter described. These codes and indicia are then applied to a speech sound synthesizer 24 which, in accordance with methods also described in more detail hereinafter, produces a digital train of speech signals. This digital train is fed to a digital-to-analog converter 26 which converts it into an analog sound signal suitable for driving the loudspeaker 28.

Figure 2:
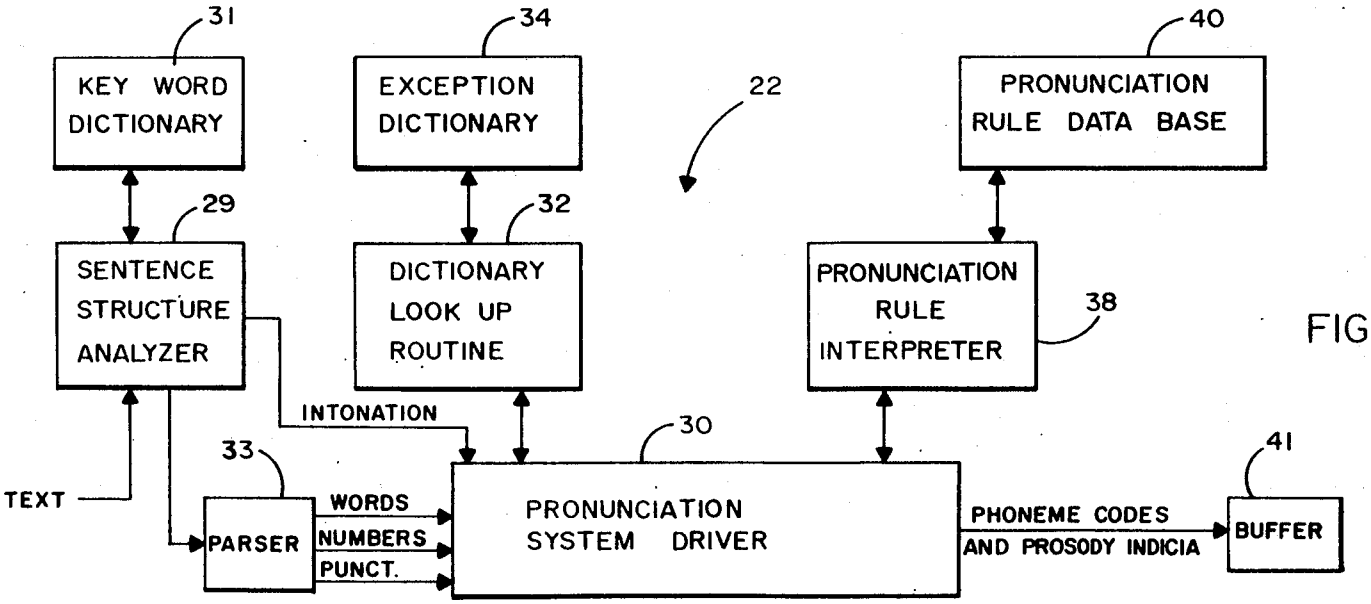
FIG. 2 is a block diagram showing details of the pronunciation system of FIG. 1.

The operation of the pronunciation system 22 is shown in more detail in FIG. 2.

The text is first applied, sentence by sentence, to a sentence structure analyzer 29 which detects punctuation and conjunctions (e.g. "and", "or") to isolate clauses. The sentence structure analyzer 29 then compares each word of a clause to a key word dictionary 31 which contains pronouns, prepositions, articles and the like which affect the prosody (i.e. intonation, volume, speed and rhythm) of the words in the sentence. The sentence structure analyzer 29 applied standard rules of prosody to the sentence thus analyzed and derives therefrom a set of prosody indicia which constitute the prosody data discussed hereinafter.

The text is next applied to a parser 33 which parses the sentence into words, numbers and punctuation which affects pronunciation (as, for example, in numbers). The parsed sentence elements are then appropriately processed by a pronunciation system driver 30. For numbers, the driver 30 simply generates the appropriate phoneme sequence and prosody indicia for each numeral or group of numerals. depending on the length of the number (e.g. "three/point/four"; "thirty-four";

"three/hundred-and/forty"; "three/thousand/four/-hundred"; etc.).

For text words, the driver 30 first removes and encodes any obvious affixes, such as the suffix "-ness". for example, which do not affect the pronunciation of the root word. The root word is then fed to the dictionary lookup routine 32. The routine 32 is preferably a software program which interrogates the exception dictionary 34 to see if the root word is listed therein. The dictionary 34 contains the phoneme code sequences of all those words which do not follow normal pronunciation rules.

If a word being examined by the pronunciation system is listed in the exception dictionary 34, its phoneme code sequence is immediately retrieved, concatenated with the phoneme code sequences of any affixes, and forwarded to the speech sound synthesizer 34 of FIG. 1 by the pronunciation system driver 30. If, on the other hand, the word is not found in the dictionary 34, the pronunciation system driver 30 then applies it to the pronunciation rule interpreter 38 in which it is examined letter by letter to identify phonetically meaningful letters or letter groups. The pronunciation of the word is then determined on the basis of standard pronunciation rules stored in the data base 40. When the interpreter 38 has thus constructed the appropriate pronunciation of an unlisted word, the corresponding phoneme code sequence is transmitted by the pronunciation system driver 30.

Inasmuch as in a spoken sentence, words are often run together, the phoneme code sequences of individual words are not transmitted as separate entities, but rather as parts of a continuous stream of phoneme code sequences representing an entire sentence. Pauses between words (or the lack thereof) are determined by the prosody indicia generated partly by the sentence structure analyzer 29 and partly by the pronunciation driver 30. Prosody indicia are interposed as required between individual phoneme codes in the phoneme code sequence.

The code stream put out by pronunciation system driver 30 and consisting of phoneme codes interfaced with prosody indicia is stored in a buffer 41. The code stream is then fetched, item by item, from the buffer 41 for processing by the speech sound synthesizer 24 in a manner hereafter described.

Figure 3:
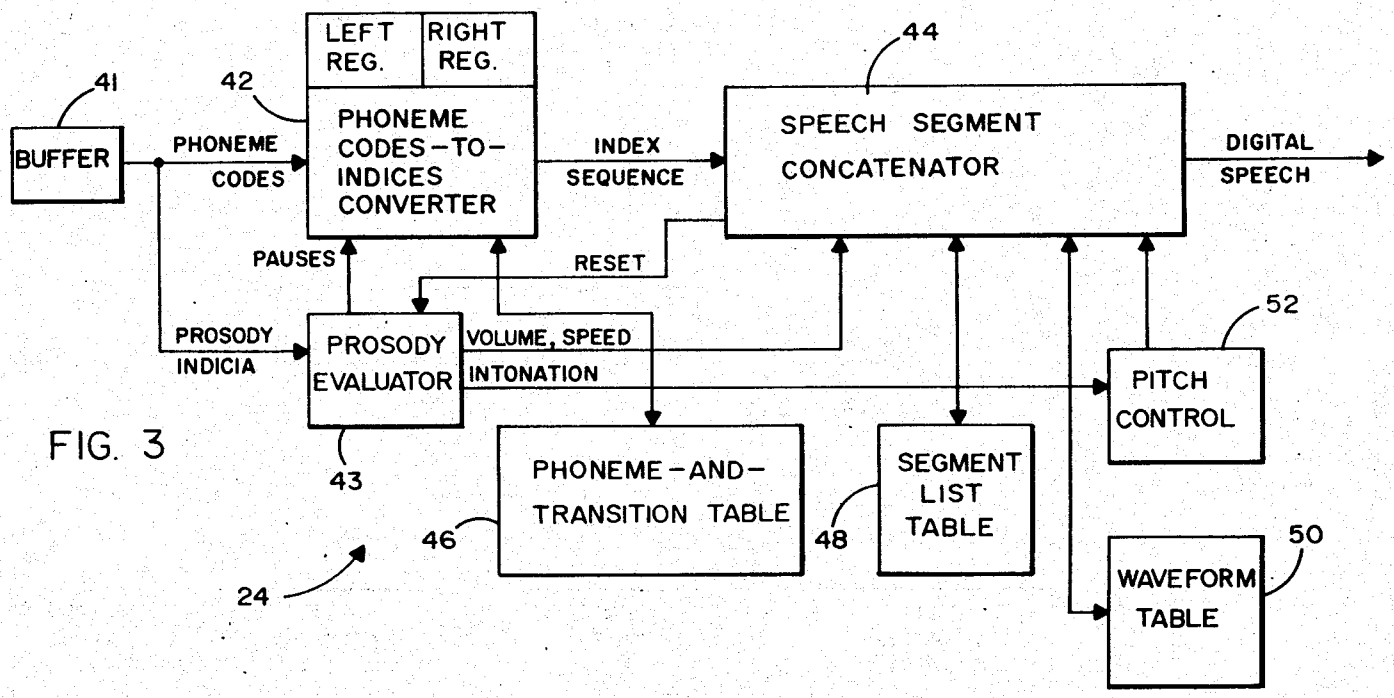
FIG. 3 is a block diagram showing details of the speech sound synthesizer of FIG. 1.

As will be seen from FIG. 3, which shows the speech sound synthesizer 24 in detail, the input stream of phoneme codes is first applied to the phoneme-codes-to-indices converter 42. The converter 42 translates the incoming phoneme code sequence into a sequence of indices each containing a pointer and flag, or an interpolation code, appropriate for the operation of the speech segment concatenator 44 as explained below. For example, if the word "speech" is to be encoded, the pronunciation rule interpreter 38 of FIG. 2 will have determined that the phonetic code for this word consists of the phonemes s-p-ee-ch. Based on this information, the converter 42 generates the following index sequence:

(1) Silence-to-S transition;
(2) S phoneme;
(3) S-to-P transition;
(4) P phoneme;
(5) P-to-EE transition;
(6) EE phoneme;
(7) EE-to-CH transition;
(8) CH phoneme;
(9) CH-to-silence transition.

The length of the silence preceding and following the word, as well as the speed at which it is spoken, is determined by prosody indicia which, when interpreted by prosody evaluator 43, are translated into appropriate delays or pauses between successive indices in the generated index sequence.

The generation of the index sequence preferably takes place as follows: The converter 42 has two memory registers which may be denoted "left" and "right". Each register contains at any given time one of two consecutive phoneme codes of the phoneme code sequence. The converter 42 first looks up the left and right phoneme codes in the phoneme-and-transition table 46. The phoneme-and-transition table 46 is a matrix, typically of about 50×50 element size, which contains pointers identifying the address, in the segment list 48, of the first segment block of each of the speech segment sequences that must be called up in order to produce the 50-odd phonemes of the English language and those of the 2,500-odd possible transitions from one to the other which cannot be handled by interpolation.

The table 46 also contains, concurrently with each pointer, a flag indicating whether the speech segment sequence to which the pointer points is to be read in forward or reverse order as hereinafter described.

The converter 42 now retrieves from table 46 the pointer and flag corresponding to the speech segment sequence which must be performed in order to produce the transition from the left phoneme to the right phoneme. For example, if the left phoneme is "s" and the right phoneme is "p", the converter 42 begins by retrieving the pointer and flag for the s-p transition stored in the matrix of table 46. If, as in most transitions between voiced phonemes, the value of the pointer in table 46 is nil, the transition is handled by interpolation as hereinafter discussed.

The pointer and flag are applied to the speech segment concatenator 44 which uses the pointer to address, in the segment list table 48, the first segment block 56 (FIG. 4) of the segment sequence representing the transition between the left and right phonemes. The flag is then used to fetch the blocks of the segment sequence in the proper order (i e. forward or reverse). The concatenator 44 uses the segment blocks, together with prosody information, to construct a digital representation of the transition in a manner discussed in more detail below.

Next, the converter 42 retrieves from table 46 the pointer and flag corresponding to the right phoneme, and applies them to the concatenator 44. The converter 42 then shifts the right phoneme to the left register, and stores the next phoneme code of the phoneme code sequence in the right register. The above-described process is then repeated. At the beginning of a sentence, a code representing silence is placed in the left register so that a transition from silence to the first phoneme can be produced. Likewise, a silence code follows the last phoneme code at the end of a sentence to allow generation of the final transition out of the last phoneme.

Figure 4:
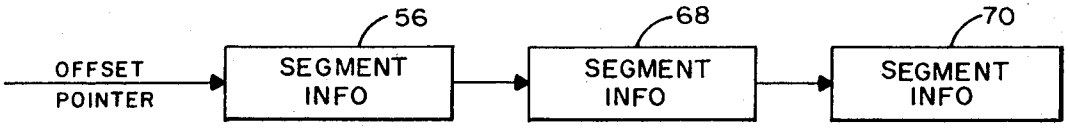
FIG. 4 is a block diagram illustrating the structure of the segment block sequence used in the speech segment concatenation of FIG. 3.
Figure 5:
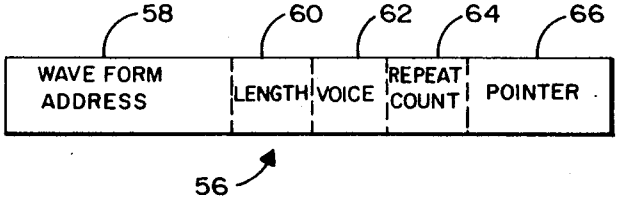
FIG. 5 is a detail of one of the segment block of FIG. 4.

FIGS. 4 and 5 illustrate the information contained in the segment list table 48. The pointer contained in the phoneme-and-transition table 46 for a given phoneme or transition denotes the offset address of the first segment block of the sequence in the segment list table 48 which will produce that phoneme or transition. Table 48 contains, at the address thus generated, a segment block 56 which is depicted in more detail in FIG. 5.

The segment block 56 contains first a waveform offset address 58 which determines the location, in the waveform table 50, of the waveform to be used for that particular segment. Next, the segment word 56 contains length information 60 which defines the number of equidistant locations (e.g. 61 in FIGS. 6, 10 and 11) at which the waveform identified by the address 58 is to be digitally sampled (i.e. the length of the portion of the selected waveform which is to be used).

A voice bit 62 in segment block 56 determines whether the waveform of that particular segment is voiced or unvoiced. If a segment is voiced, and the preceding segment was also voiced, the segments are interpolated in the manner described hereinbelow. Otherwise, the segments are merely concatenated. A repeat count 64 defines how many times the waveform identified by the address 58 is to be repeated sequentially to produce that particular segment of the phoneme or transition. Finally, the pointer 66 contains an offset address for accessing the next segment block 68 of the segment block sequence. In the case of the last segment block 70, the pointer 66 is nil.

Although some transitions are not time-invertible due to stop-and-burst sequences, most others are. Those that are invertible are generally between two voiced phonemes, i.e. the vowels, liquids (for example l, r), glides (for example w, y), and voiced sibilants (for example v, z), but not the voiced stops (for example b, d). Transitions are invertible when the transitional sound from a first phoneme to a second phoneme is the reverse of the transitional sound when going from the second to the first phoneme.

As a result, a substantial amount of memory can be saved in the segment list table by using the directional flag associated with each pointer in the phoneme-and-transition table 46 to fetch a transition segment sequence into the concatenator 44 in forward order for a given transition (for example, 1-ā as in "last"), and in reverse order for the corresponding reverse transition (for example, ā-1 as in "algorithm").

Figure 6:
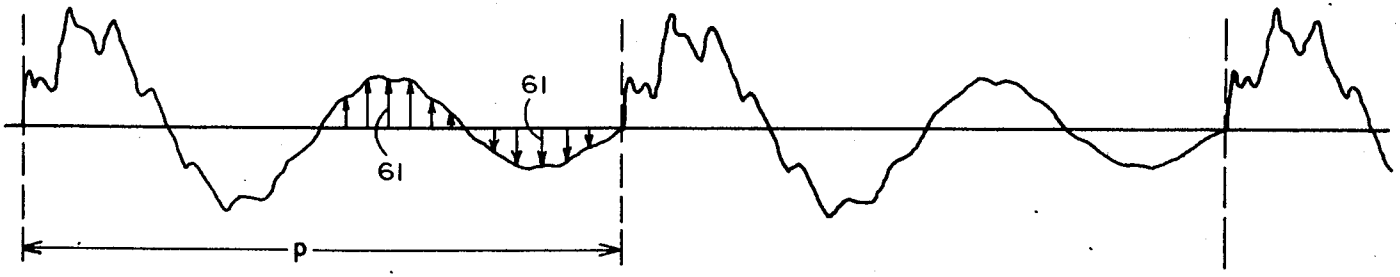
FIG. 6 is a time-amplitude diagram illustrating a series of concatenated segments of a voiced phoneme.

The reverse reading of a transition by concatenating individual segments in reverse order, rather than by reading individual wave form samples in reverse order, is an important aspect of this invention. The reason for doing this is that all waveforms stored in the table 50 are arranged so as to begin and end with a rising zero crossing. Were this not done, any substantial discontinuities created in the wave train by the concatenation of short waveforms would produce spurious voice clicks resulting in an odd tone. In order to preserve this in-phase relationship, however, the waveforms in table 50 must always be read in a forward direction, even though the segments in which they lie may be concatenated in reverse order. This arrangement is illustrated in FIG. 6 with a sequence of voiced waveforms in which the individual waveform stored in table 50 is the waveform of a single voiced period. The significance and use of this particular waveform length will be discussed in detail hereinafter.

Figure 7:
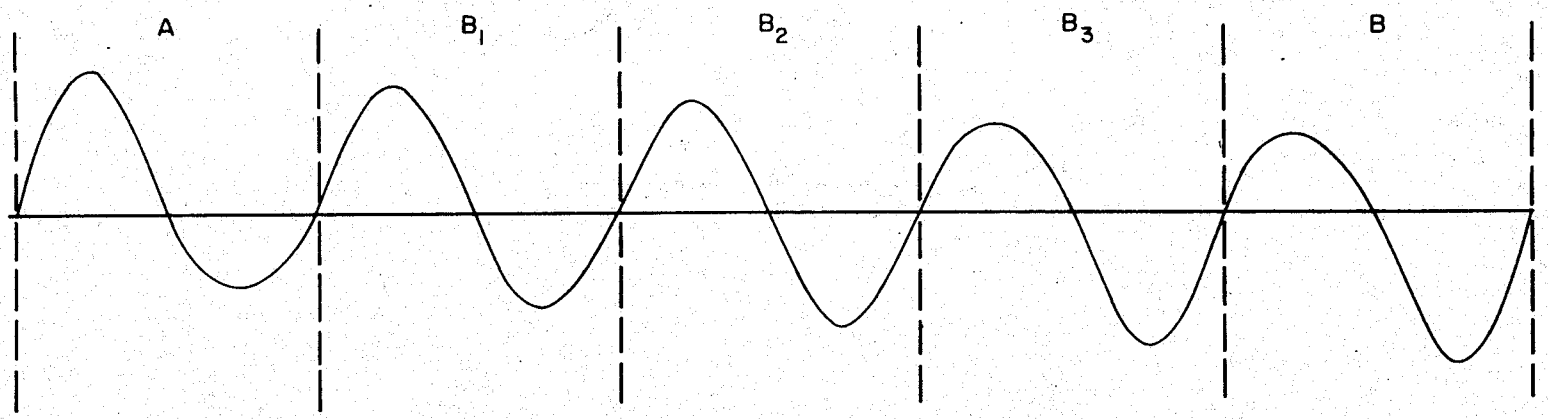
FIG. 7 is a time-amplitude diagram illustrating a transition by interpolation.
Figure 8:
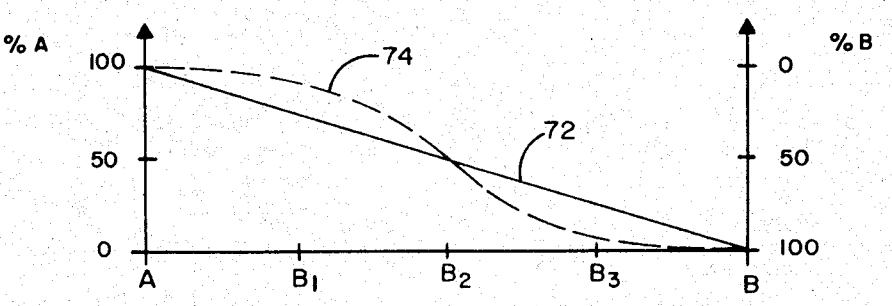
FIG. 8 is a graphic representation of various interpolation procedures.

A very large amount of memory space can be saved by using an interpolation routine, rather than a segment word sequence, when (as is the case in many voiced phoneme-to-voiced phoneme transitions) the transition is a continuous, more or less linear change from one waveform to another. As illustrated in FIGS. 7 and 8, a transition of that nature can be accomplished very simply by retrieving both the incoming and outgoing phoneme waveform and producing a series of intermediate waveforms representing a gradual interpolation from one to the other in accordance with the percentage ratios shown by line 72 in FIG. 8. Although a linear contour is generally the easiest to accomplish, it may be desirable to introduce non-linear contours such as 74 in special situations.

As shown in FIG. 7, an interpolation in accordance with the invention is done not as an interposition between two phonemes, but as a modification of the initial portion of the second phoneme. In the example of FIG. 7, a left phoneme (in the converter 42) consisting of many repetitions of a first waveform A is directly concatenated with a right phoneme consisting of many repetitions of a second waveform B. Interpolation having been called for, the system puts out, for each repetition, the average of that repetition and the three preceding ones.

Thus, repetition, A is 100% waveform A. $B_1$ is 75% A and 25% B; $B_2$ is 50% A and 50% B; $B_3$ is 25% A and 75% B; and finally, B is 100% waveform B.

A special case of interpolation is found in very long transitions such as "oy". The human ear recognizes a gradual frequency shift of the formants $f_1$, $f_2$, $f_3$ (FIG. 9*c*) as characteristic of such transitions. These transitions cannot be handled by extended gradual interpolation, because this would produce not a continuous lateral shift of the formant peaks, but rather an undulation in which the formants become temporarily obscured. Consequently, the invention uses a sequence of, e.g. 3 or 4 segments, each repeated a number of times and interpolated with each other as described above, in which the formants are progressively displaced. For example, a long transition in accordance with this invention may consist of four repetitions of a first intermediate waveform interpolated with four repetitions of a second intermediate waveform, which is in turn interpolated with four repetitions of a third intermediate waveform. This method saves a substantial amount of memory by requiring (in this example) only three stored waveforms instead of twelve.

The memory savings produced by the use of interpolation and reverse concatenation are so great that in a typical embodiment of the invention, the 2,500-odd transitions can be handled using only about 10% of the memory space available in the segment list table 48. The remaining 90% are used for the segment storage of the 50-odd phonemes.

Figures 9A, 9B, 9C:
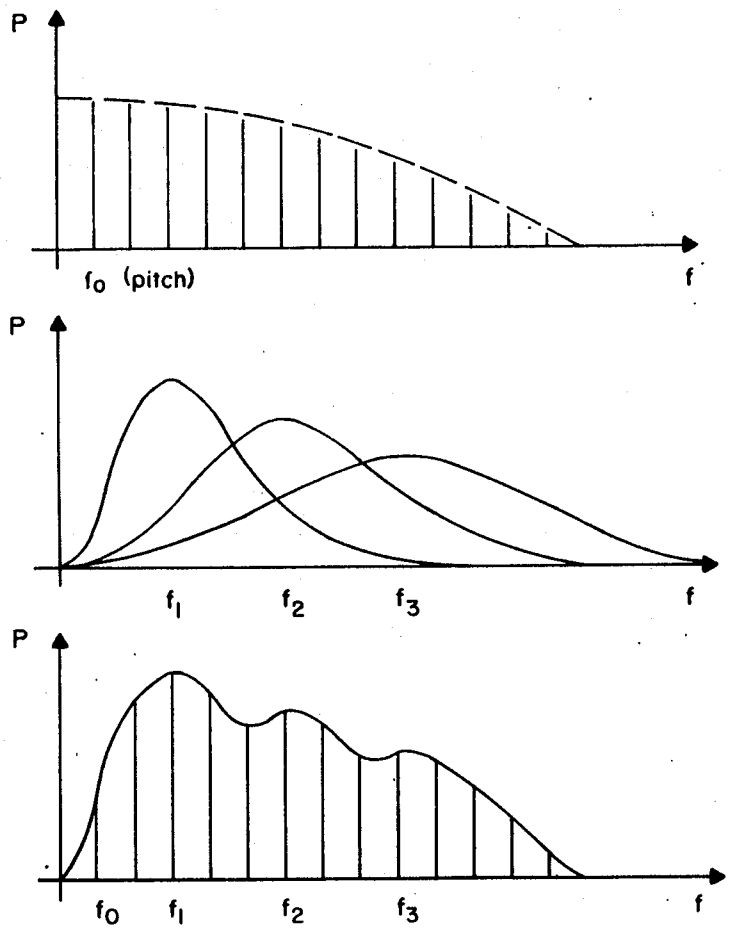
FIGS. 9*a, b* and *c* are frequency-power diagrams illustrating the frequency distribution of voiced phonemes.

A particular problem arises when it is desired to give artificial speech a natural sound by varying its pitch, both to provide intonation and to provide a more natural timbre to the voice. This problem arises from the nature of speech as illustrated in FIGS. 9*a* through 9*c*. FIG. 9*a* illustrates the frequency spectrum of the sound produced by the snapping of the vocal cords. The original vocal cord sound has a fundamental frequency of $f_o$ which represents the pitch of the voice. In addition, the vocal cords generate a large number of harmonics of decreasing amplitude. The various body cavities which are involved in speech generation have different frequency responses as shown in FIG. 9*b*. The most significant of these are the formants $f_1$, $f_2$ and $f_3$ whose position and relative amplitude determine the identity of any particular voiced phoneme. Consequently, as shown in FIG. 9*c*, a given voiced phoneme is identified by a frequency spectrum such as that shown in FIG. 9*c* in which $f_o$ determines the pitch and $f_1$, $f_2$ and $f_3$ determine the identity of the phoneme.

Voiced phonemes are typically composed of a series of identical voice periods p (FIG. 6) whose waveform is coposed of three decaying frequencies corresponding to the formants $f_1$, $f_2$ and $f_3$. The length of the period p determines the pitch of the voice. If it is desired to change the pitch, compression of the waveform characterizing the voice period p is undesirable, because doing so alters the position of the formants in the frequency spectrum and thereby impairs the identification of the phoneme by the human ear.

Figure 10:
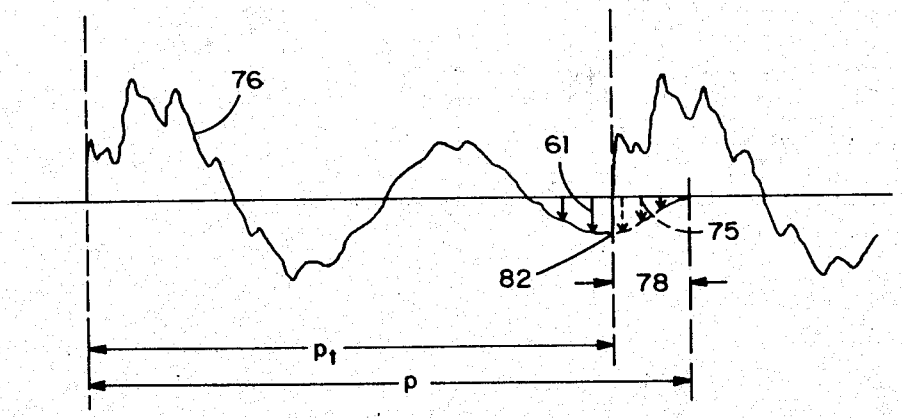
FIG. 10 is a time-amplitude diagram illustrating the truncation of a voice phoneme segment.
Figure 11:
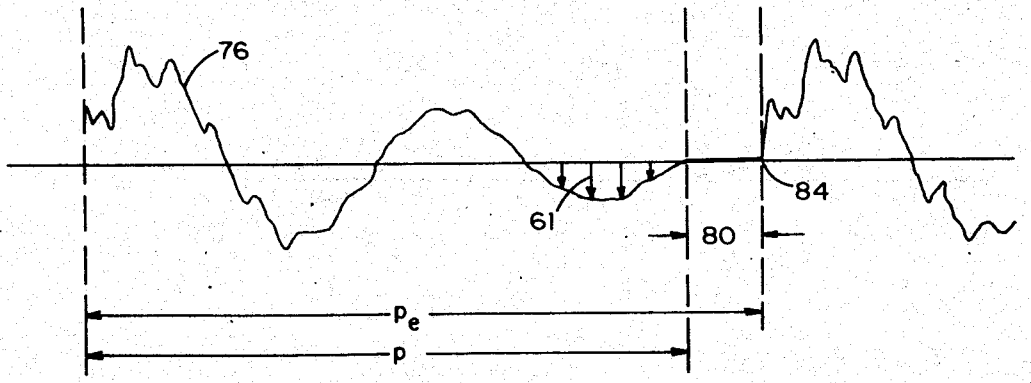
FIG. 11 is a time-amplitude diagram illustrating the extension of a voiced phoneme segment.

As shown in FIGS. 10 and 11, the present invention overcomes this problem by truncating or extending individual voice periods to modify the length of the voice periods (and thereby changing the pitch-determining voice period repetition rate) without altering the most significant parts of the waveform. For example, in FIG. 10 the pitch is increased by discarding the samples 75 of the waveform 76, i.e. omitting the interval 78. In this manner, the voice period p is shortened to the period $p_t$, and the pitch of the voice is increased by about $12\frac{1}{2}$.

As shown in FIG. 11, the reverse can be accomplished by extending the voice period through the expedient of adding zero-value samples to produce a flat waveform during the interval 80. In this manner, the voice period p is extended to the length $p_e$, which results in an approximately $12\frac{1}{2}$% decrease in pitch.

The truncation of FIG. 10 and the extension of FIG. 11 both result in a substantial discontinuity in the concatenated wave form at point 82 or point 84. However, these discontinuities occur at the end of the voice period where the total sound power has decayed to a small percentage of the power at the beginning of the voice period. Consequently, the discontinuity at point 82 or 84 is of low impact and is acoustically tolerable even for high-quality speech.

The pitch control 52 (FIG. 3) controls the truncation or extension of the voiced waveforms in accordance with several parameters. First, the pitch control 52 automatically varies the pitch of voiced segments rapidly over a narrow range (e.g. 1% at 4 Hz). This gives the voiced phonemes or transitions a natural human sound as opposed to the flat sound usually associated with computer-generated speech.

Secondly, under the control of the intonation signal from prosody evaluator 43, the pitch control 52 varies the overall pitch of selected spoken words so as, for example, to raise the pitch of a word followed by a question mark in the text, and lower the pitch of a word followed by a period.

Figure 12:
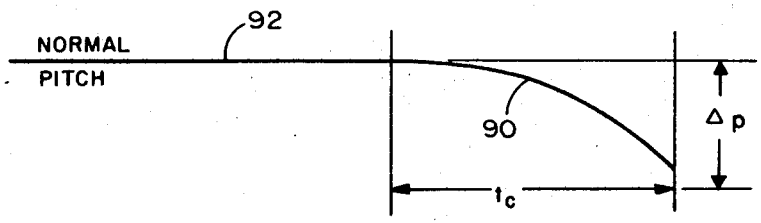
FIG. 12 is a time-amplitude diagram illustrating a pitch change.
Figure 13:
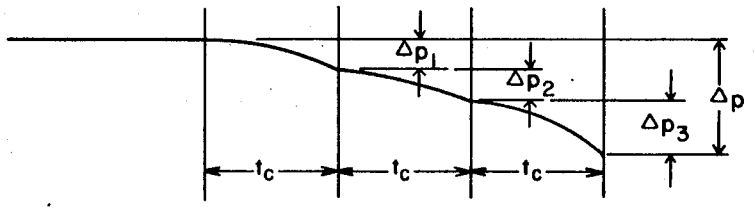
FIG. 13 is a time-amplitude diagram illustrating a compound pitch change.

FIGS. 12 and 13 illustrate the functioning of the pitch control 52. Toward the end of a sentence, the intonation output prosody evaluator 43 may give the pitch control 52 a "drop pitch by 10%" signal. The pitch control 52 has built into it a pitch change function 90 (FIG. 12) which changes the pitch control signal 92 to concatenator 44 by the required target amount $\Delta p$ over a fixed time interval $t_c$. The time $t_c$ is so set as to represent the fastest practical intonation-related pitch change. Slower changes can be accomplished by successive intonation signals from prosody evaluator 43 commanding changes by portions $\Delta p_1$, $\Delta p_2$, $\Delta p_3$ of the target amount $\Delta p$ at intervals of $t_c$ (FIG. 13).

Figure 14:
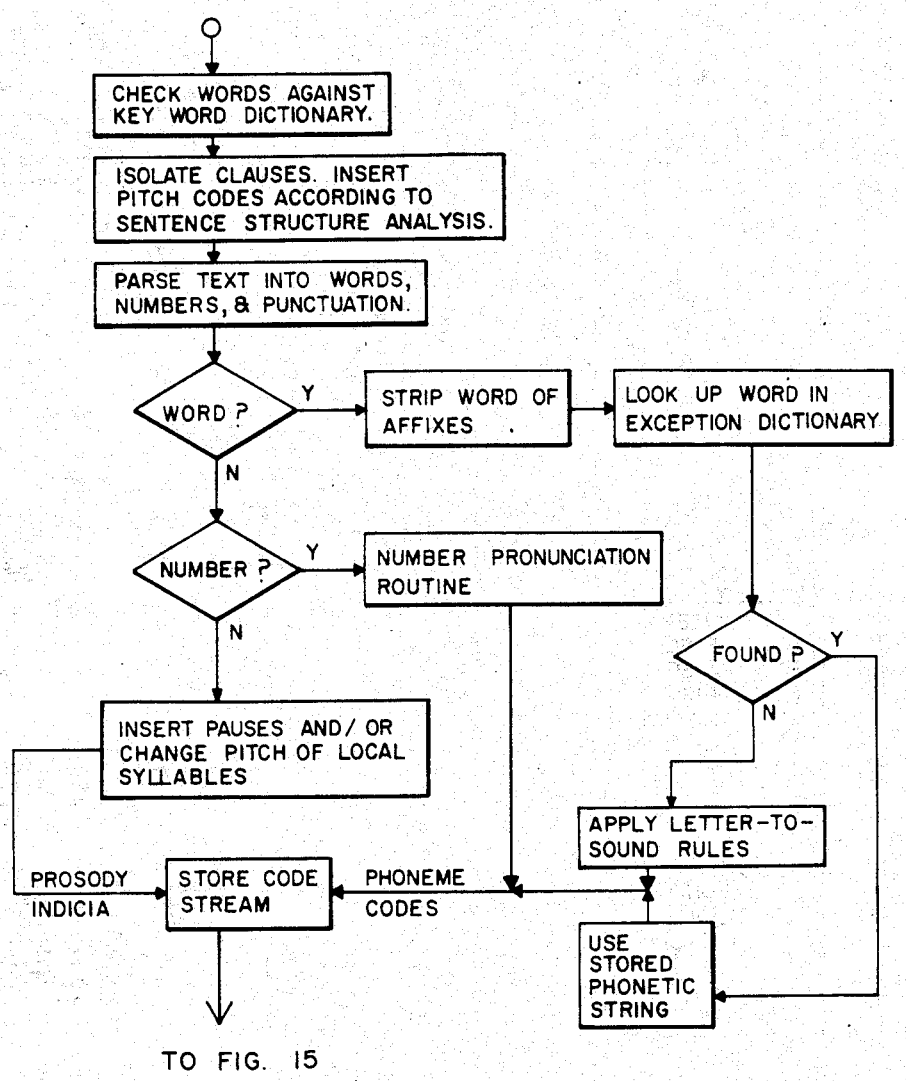
FIGS. 14 and 15 are flow charts illustrating a software program adapted to carry out the invention.
Figure 15:
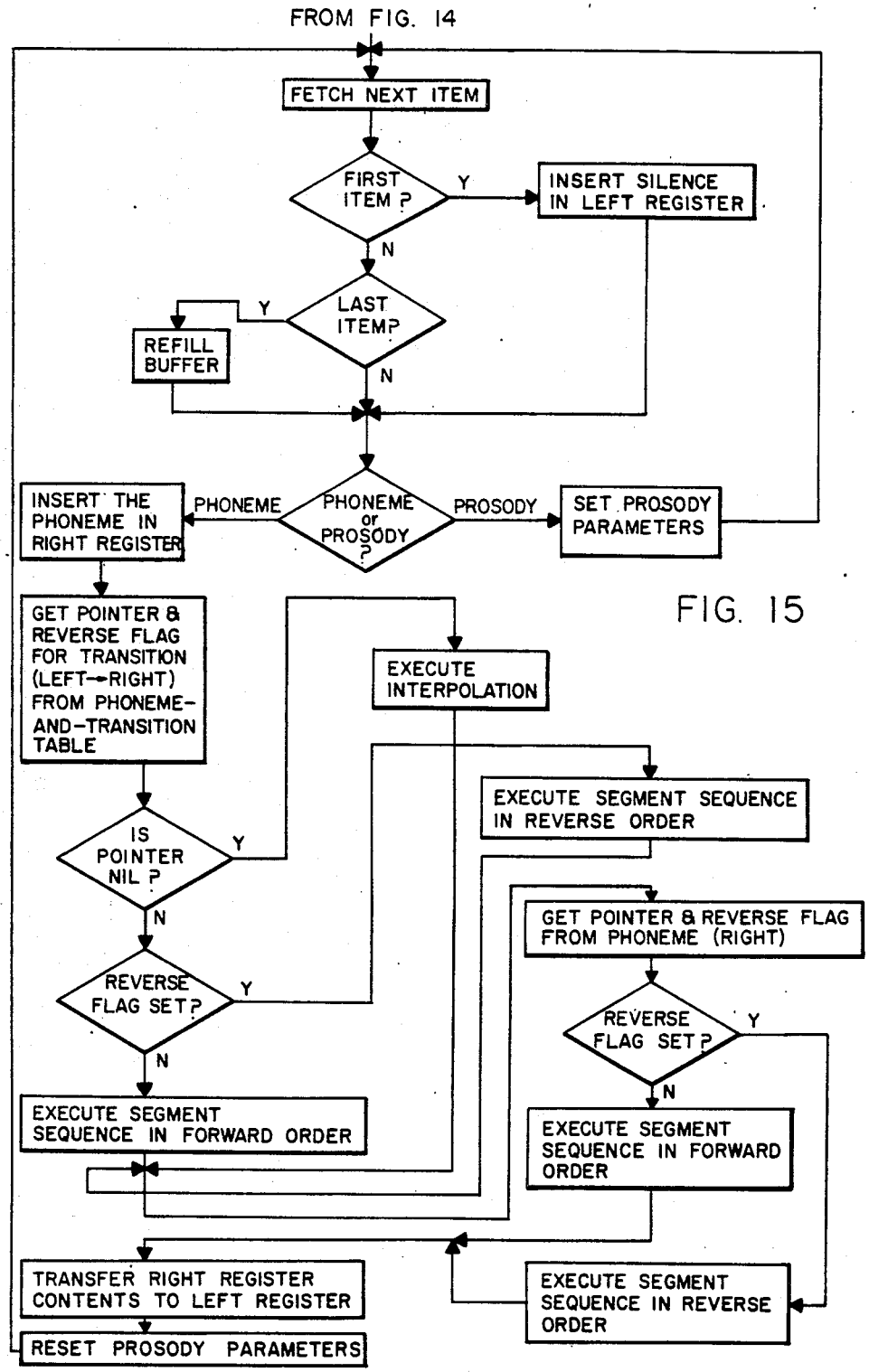

FIGS. 14 and 15 illustrate a typical software program which may be used to carry out the invention. FIG. 14 corresponds to the pronunciation system 22 of FIG. 1, while FIG. 15 corresponds to the speech sound synthesizer 24 of FIG. 1. As shown in FIG. 14, the incoming text stream from the text source 20 of FIG. 1 is first checked word by word against the key word dictionary 31 of FIG. 2 to identify key words in the text stream.

Based on the identification of conjunctions and significant punctuation, the individual clauses of the sentence are then isolated. Based on the identification of the remaining key words, pitch codes are then inserted between the words to mark the intonation of the individual words within each clause according to standard sentence structure analysis rules.

Having thus determined the proper pitch contour of the text, the program then parses the text into words, numbers, and punctuation. The term "punctuation" in this context includes not only real punctuation such as commas, but also the pitch codes which are subsequently evaluated by the program as if they were punctuation marks.

If a group of symbols put out by the parsing routine (which corresponds to the parser 33 in FIG. 1) is determined to be a word, it is first stripped of any obvious affixes and then looked up in the exception dictionary 34. If found, the phoneme string stored in the exception dictionary 34 is used. If it is not found, the pronunciation rule interpreter 38, with the aid of the pronunciation rule data base 40, applies standard letter-to-sound conversion rules to create the phoneme string corresponding to the text word.

If the parsed symbol group is identified as a number, a number pronunciation routine using standard number pronunciation rules produces the appropriate phoneme string for pronouncing the number. If the symbol group is neither a word nor a number, then it is considered punctuation and is used to produce pauses and/or pitch changes in local syllables which are encoded into the form of prosody indicia. The code stream consisting of phoneme codes interlaced with prosody indicia is then stored, as for example in a buffer 41, from which it can be fetched, item by item, by the speech sound synthesizer program of FIG. 15.

The program of FIG. 15 is a continuous loop which begins by fetching the next item in the buffer 41. If the fetched item is the first item in the buffer, a "silence" phoneme is inserted in the left register of the phoneme-codes-to-indices converter 42 (FIG. 3). If it is the last item the buffer 41 is refilled.

The fetched item is next examined to determine whether it is a phoneme or a prosody indicium. In the latter case the indicium is used to set the appropriate prosody parameters in the prosody evaluator 43, and the program then returns to fetch the next item. If, on the other hand, the fetched item is a phoneme, the phoneme is inserted in the right register of the phoneme-codes-to-indices converter 42.

The phoneme-and-transition table 46 is now addressed to get the pointer and reverse flag corresponding to the transition from the left phoneme to the right phoneme. If the pointer returned by the phoneme-and-transition table 46 is nil, an interpolation routine is executed between the left and right phoneme. If the pointer is other than nil and the reverse flag is present, the segment sequence pointed to by the pointer is executed in reverse order.

The execution of the segment sequence consists, as previously described herein, of the fetching of the waveforms corresponding to the segment blocks of the sequence stored in the segment list table 48, their interpolation when appropriate, their modification in accordance with the pitch control 52, and their concatenation and transmission by speech segment concatenator 44. In other words, the execution of the segment sequence produces, in real time, the pronunciation of the left-to-right transition.

If the reference flag fetched from the phoneme-and-transition table 46 is not set, the segment sequence pointed to by the pointer is executed in the same way but in forward order.

Following execution of the left-to-right transition, the program fetches the pointer and reverse flag for the right phoneme from the phoneme-and-transition table 46. This computation is very fast and therefore causes only an undetectably short pause between the pronunciation of the transition and the pronunciation of the right phoneme. With the aid of the pointer and reverse flag, the pronunciation of the right phoneme now takes place in the same manner as the pronunciation of the transition described above.

Following the pronunciation of the right phoneme, the contents of the right register of phoneme-codes-to-indices converter 42 are transferred into the left register so as to free the right register for the reception of the next phoneme. The prosody parameters are then reset, and the next item is fetched from the buffer 41 to complete the loop.

It will be seen that the program of FIG. 14 produces a continuous pronunciation of the phonemes encoded by the pronunciation system 22 of FIG. 1, with any intonation and pauses being determined by the prosody indicators inserted into the phoneme string. The speed of pronunciation can be varied in accordance with appropriate prosody indicators by reducing pauses and/or modifying, in the speech segment concatenator 44, the number of repetitions of individual voice periods within a segment in accordance with the speed parameter produced by prosody evaluator 43.

In view of the techniques described above, only a relatively low amount of computing power is needed in the apparatus of this invention to produce very high fidelity in real time with unlimited vocabulary. The architecture of the system of this invention, by storing only pointers and flags in the phoneme-and-transition table 46, reduces the memory requirements of the entire system to an easily manageable 40–50K while maintaining high speech quality with an unlimited vocabulary. The high quality of the system is due in large measure to the equal priority in the system of phonemes and transitions which can be balanced for both high quality and computational savings.

Consequently, the system ideally lends itself to use on the present generation of microcomputers with the addition of only a minimum of hardware in the form of conventional very-large-scale-integrated (VSLI) chips commonly available for microprocessor applications.

We claim:

1. A machine method of converting electrical signals representing text to audible speech in real time, comprising the steps of:

(a) storing, in the memory of a data processing device, a plurality of digitized waveforms consisting of groups of digitally encoded samples, said waveforms being representative of portions of phonemes and of transitions between phonemes;

(b) analyzing said signals to determine a sequence of phonemes and transitions indicative of the pronunciation of said text;

(c) generating a sequence of codes representing said phonemes and transitions;

(d) using said codes to select groups of said digitized waveforms, each said group representing a phoneme or a transition;

(e) concatenating the waveforms in each of said groups to form a waveform representing the speech sound corresponding to one of said phonemes or transitions;

(f) alternatingly concatenating said phoneme-representing waveform groups and said transition-representing waveform groups to form a composite waveform train representing in digitized form, the spoken equivalent of said text; and (g) converting said digitized composite waveform into an audible analog signal representative thereof.

2. The method of claim 1, in which said analyzing step includes the steps of:

(i) comparing each group of electrical signals representing a word of said text to a list of words which do not conform to predetermined pronunciation rules; and (ii) if said word is in said list, determining said code sequence from phonetic code information pre-stored in said list; or (iii) if said word is not in said list, determining said code sequence from a letter-by-letter analysis of said word in accordance with pre-stored pronunciation rules.

3. The method of claim 1, in which said analyzing step includes the steps of:

(i) comparing each group of electrical signals representing a word of said text to a stored list of signals representing key words affecting the intonation of said text;

(ii) using thus identified key words, and signals representing punctuation in said text, to modify said digital representation in accordance with predetermined intonation patterns derived from said key words and punctuation.

4. The method of claim 1, further comprising the steps of:

(i) translating said phoneme and transition code sequence into a sequence of speech segments each defined by one or more speech segment blocks in said data processing device memory, each speech segment block identifying a specific waveform, the presence or absence of voicing, and the number of repetitions of said waveform in said segment; and (ii) concatenating said speech segments and retrieving the waveforms identified thereby to form said waveform groups.

5. The method of claim 4, in which said waveforms are stored in the form of digital samples, and the pitch of voiced speech segments is altered by truncating samples from the end of each voice period or adding zero-value samples to the end of each voice period.

6. The method of claim 1, in which predetermined ones of said transitions are formed by substituting, for at least an initial portion of the waveform representing the phoneme following said transition, an interpolation of that waveform with the waveform representing the phoneme preceding said transition.

7. The method of claim 6, in which said interpolation is linear.

8. The method of claim 4, in which, whenever two adjacent segments of said speech segment sequence are both voiced, at least a portion of the waveform identified by one of said segments adjacent the other is replaced by an interpolation of the waveforms identified by said two adjacent segments.

9. A machine method converting electrical signals representing text to audible speech, comprising the steps of:

(a) identifying, in a train of signals representing a text of substantially unlimited vocabulary including words and punctuation, signals representing key words affecting intonation;

(b) determining, on the basis of said key words and/or punctuation, intonation patterns determining the pitch of individual words or syllables, and pauses therebetween;

(c) producing, on the basis of said determined intonation patterns and pauses, prosody indica representative thereof;

(d) producing a string of phoneme codes representative of the phonemes making up the pronunciation of said text;

(e) interlacing said phoneme codes and said prosody indicia to form a code stream;

(f) storing in the memory of a data processing device, a plurality of waveforms;

(g) storing, in said memory, sequences of digital data representing segment blocks corresponds to particular phonemes and transitions therebetween, each block identifying one of said stored waveforms and containing voicing information and information regarding the repetition of said identified waveform to produce a sound;

(h) storing, in said memory, for each of said phonemes and transitions, information identifying the sequence of segment blocks corresponding to the phoneme or transition represented thereby, and the order in which it is to be read;

(i) concatenating the waveforms identified by said segment blocks in accordance with the sequence of segment blocks identified by the phoneme codes of said code stream to form a waveform train;

(j) modifying said waveforms in accordance with said prosody indicia of said code stream; and (k) converting said waveform train to a sequence of audible sounds.

10. The method of claim 9, in which said step of storing said sequence-identifying information also includes the storing of information defining whether transitions between phonemes are to be produced by interpolation of phoneme segments or by retrieval of a separate segment block sequence.

11. A method of converting a string of digital phoneme codes into a sound signal, comprising the steps of:

(a) storing, in a data processing device, first and second adjacent phoneme codes of said string as left and right phoneme codes, respectively;

(b) producing a sound signal corresponding to the transition between the phonemes represented by said left and right phoneme codes;

(c) producing a sound signal corresponding to the phoneme represented by said right phoneme code;

(d) substituting said right phoneme code for said left phoneme code to become a new left phoneme code, storing the next phoneme code to said string as a new right phoneme code; and (e) repeating steps (b) through (d) above to process said phoneme code string.

12. The method of claim 11, in which said phoneme code string extends over a plurality of words, and silence is encoded as a phoneme.

13. The method of claim 11, in which said sound-producing steps include:

(i) storing, in a first table, a first address pointer for each encodable phoneme and for each possible transition between two encodable phonemes;

(ii) storing, in a second table, a plurality of speech segment blocks containing second pointers, said blocks being stored at locations addressable by said first or second pointers; said segment blocks also containing third pointers;

(iii) storing, in a third table, a plurality of waveforms representing portions of intelligible sounds; said waveforms being addressable by said third pointers; and (iv) producing intelligible sound by concatenating said waveforms in the order established by said first and second pointers.

14. The method of claim 13, in which each pointer in said first table is associated with a directional flag; said segment blocks are arranged in sequences determined by said second pointers; and said sequences are concatenated in forward or reverse order depending upon the condition of said directional flag.

15. The method of claim 14, in which, whenever two consecutive blocks in said sequences are voiced, an interpolation of the waveform addressed by the first of said blocks with the waveform addressed by the second of said blocks is substituted for at least a portion of the waveform addressed by the second of said blocks.

16. The method of claim 14, in which said sound-producing steps further include the step of varying the pitch of segments including repetitions of voiced waveforms by truncating or extending the end of each repetition in accordance with prosody indicia inserted into said phoneme code string.

17. The method of claim 13, in which, when said first pointer has a predetermined value, said sound signal corresponding to said transition is produced by substituting, for at least a portion of said sound signal representing said right phoneme, an interpolation of the signal representing said left phoneme with the signal representing said right phoneme.

* * * * *

UNITED STATES PATENT AND TRADEMARK OFFICE

CERTIFICATE OF CORRECTION

PATENT NO. : 4,692,941

DATED : 08 September 1987

INVENTOR(S) : Jacks & Sprague

It is certified that error appears in the above—identified patent and that said Letters Patent is hereby corrected as shown below:

Title page:

In the ABSTRACT:

Col. 2, line 4 "test" should read --text--;

Col. 2, line 21 "chanbes" should read --changes--;

In the SPECIFICATION:

Col. 5, line 4 The period after "-ness" should be a comma.

Col. 9, line 3 "coposed" should read --composed--;

Col. 9, line 21 "12 1/2" should read --12 1/2%--;

In the CLAIMS:

Col. 13, line 3 After "method" insert --of--;

Signed and Sealed this

Eighth Day of March, 1988

*Attest:*

DONALD J. QUIGG

*Attesting Officer*

*Commissioner of Patents and Trademarks*